US006224943B1

(12) United States Patent
Knepper et al.

(10) Patent No.: US 6,224,943 B1
(45) Date of Patent: May 1, 2001

(54) METHOD FOR IMPROVING THE CORROSION RESISTANCE OF REINFORCED CONCRETE

(75) Inventors: Michael Knepper, Muelheim; Jochen Spriestersbach, Marl; Juergen Wisniewski, Wesel, all of (DE)

(73) Assignee: Grillo-Werke AG, Duisburg (DE)

( * ) Notice: Subject to any disclaimer, the term of this patent is extended or adjusted under 35 U.S.C. 154(b) by 0 days.

(21) Appl. No.: 09/509,837

(22) PCT Filed: Oct. 14, 1998

(86) PCT No.: PCT/EP98/06512

§ 371 Date: Apr. 24, 2000

§ 102(e) Date: Apr. 24, 2000

(87) PCT Pub. No.: WO99/23282

PCT Pub. Date: May 14, 1999

(30) Foreign Application Priority Data

Oct. 31, 1997 (DE) ..... 197 48 105

(51) Int. Cl.[7] ..... B05D 1/38

(52) U.S. Cl. ..... 427/261; 427/287; 427/406; 427/409; 427/410; 427/407.1; 427/455

(58) Field of Search ..... 405/211, 211.1, 405/216; 428/450; 427/455, 406, 409, 411, 407.1, 261, 287, 410

(56) References Cited

U.S. PATENT DOCUMENTS

| | | | | |
|---|---|---|---|---|
| 4,506,485 | * | 3/1985 | Apostolos | 405/211 |
| 4,619,557 | * | 10/1986 | Salama et al. | 405/211 |
| 5,069,822 | | 12/1991 | Callaghan et al. . | |
| 5,296,120 | | 3/1994 | Bennett et al. . | |

FOREIGN PATENT DOCUMENTS

| | | | |
|---|---|---|---|
| 275 487 A1 | | 1/1990 | (DE) . |
| 0 581 433 A1 | | 2/1994 | (EP) . |
| 0 591 775 A1 | | 4/1994 | (EP) . |
| 0 677 592 A1 | | 4/1995 | (EP) . |
| 0 669 299 A2 | | 8/1995 | (EP) . |
| 677 592 A1 | * | 10/1995 | (EP) . |
| 2 140 456 | | 11/1984 | (GB) . |
| 2 216 140 | | 10/1989 | (GB) . |
| 1-224285 | * | 9/1989 | (JP) . |

* cited by examiner

*Primary Examiner*—Katherine A. Bareford
(74) *Attorney, Agent, or Firm*—Jacobson, Price, Holman & Stern, PLLC

(57) ABSTRACT

The method for improving the corrosion resistance of reinforced concrete coated with a thermal spray coat of metals, especially of zinc or zinc alloys, is effected by electrically connecting said spray coat with the armour and additionally coating it with a polyurethane resin which is applied as a low-viscosity solution in organic solvents.

8 Claims, No Drawings

METHOD FOR IMPROVING THE CORROSION RESISTANCE OF REINFORCED CONCRETE

This is a 371 of PCT/EP98/06512, filed Oct. 14, 1998.

The present invention relates to a method for improving the corrosion resistance of reinforced concrete coated with a thermal spray coat of metals, especially of zinc or zinc alloys.

Thermal spray coats of zinc or zinc aluminum alloys are employed for the surface refinement of metals, plastics, concrete, paperboard etc. Improvements include the temperature resistance, wear performance and electric conductivity of the substrate materials.

From EP-A-0 677 592, a method is known for improving the adherence of thermal spray coats of metals, metal oxides or mechanically resistant materials, especially of zinc, aluminum and their alloys, in which after spraying, the spray coats are coated with a one-component moisture-curing polyurethane resin. This method has gained particular importance for workpieces of steel. It is mentioned that usual coating systems compatible with polyurethane resins can be applied to the thus applied polyurethane resin coat. No examples thereof are mentioned. However, there had already been observed that materials such as alkyd resins, epoxy resins or PVC resins will not sufficiently adhere to the metal spray coats without the polyurethane resin coat.

It has been the object of the present invention to provide improvement of the corrosion resistance of reinforced concrete coated with a thermal spray coat of metals, especially of zinc or zinc alloys, and the adherence of the spray coat to the concrete is also to be improved, if possible.

According to the invention, this object is achieved by electrically connecting the spray coat with the armour of the reinforced steel and additionally coating it with a polyurethane resin which is applied as a low-viscosity solution in organic solvents.

Preferably, the polyurethane resin coat is applied at so low a thickness that a continuous film does not form, but only the pores of the spray coat are closed.

Particularly good results are achieved if an epoxy resin coat is additionally applied after the curing of the polyurethane resin. Said epoxy resin coat is preferably applied to have a thickness of from 200 to 400 $\mu$m after curing. Further useful are polyurethane coats and coats of mixed epoxy resins and polyurethanes.

The spray coat of zinc or zinc alloys on the concrete is generally from 100 to 400 $\mu$m, preferably from 150 to 300 $\mu$m. When the adherence is measured by front end peeling, such spray coats exhibit values of between 1.0 and 2.0 MPa. After the polyurethane resin coat has been applied, the adherence of the zinc coat to the concrete surprisingly rises to from 2.5 to 3.0 MPa. If an epoxy resin coat is applied after the curing of the polyurethane coat, adherence values of between 2.5 and 3.5 MPa are measured after its having cured.

It is essential to the success of the method that the coat applied according to the invention be electrically connected with the armour of the reinforced concrete. To this end, it is necessary to establish an electrically conducting connection between the metal armour of the reinforced steel and the surface of the concrete. This is a measure which has been taken with hesitation to date, because parts of the armour which are not covered by the concrete will come into contact with the environment and are actually considered as defects in which corrosion of the reinforced concrete will occur particularly quickly. According to the invention, it is further possible to use the coats as anodes for active cathodic protection using external current.

Another unexpected advantage of the method according to the invention is the fact that the coating with polyurethane resin improves not only the adherence of the spray coat to the concrete, but also the durability of the spray coat. The intrinsic corrosion of the zinc coat under humid atmospheric conditions is greatly reduced, and thus the durability of the spray coat is increased. Corrosion experiments in a salt spray test according to DIN 50121-SS have shown that as much as 60% of a layer of 100 $\mu$m thickness is eroded in 336 hours. After the polyurethane resin layer has been applied, the erosion of the zinc spray coat is only 13%. If an epoxy resin layer is additionally applied, the intrinsic corrosion of the spray coat will be reduced to virtually 0.

In the method according to the invention, before the metal spray coat is applied, care must be taken that the reinforced concrete is first cleaned, blasted, preheated to 70° C. to 90° C., and only then the metal is applied by spray coating. The cleanness and the roughness of the substrate surface are of particular importance. A profile which is sharp-edged to some extent is often even necessary to ensure the necessary adherence. Preheating can be dispensed with only if it is ensured that the concrete surface is no longer moist. Otherwise, the zinc spray coat will not have sufficient adherence.

For the metallic spray materials, various spraying methods can be employed, for example, wire flame spraying or wire arc spraying. These methods are distinguished primarily by different process temperatures and thus also by different application efficiencies. The adherences to concrete depend not only on surface pretreatment, but also on the type of concrete to be protected. The spray coats are more or less dense depending on their thickness and method of spraying. To ensure sufficient corrosion protection, the thickness should preferably be within a range of from 150 to 300 $\mu$m.

Attempts to apply an epoxy coat immediately to the spray coat have had completely unsatisfactory results, whereas surprisingly good results are obtained if a polyurethane coat is first applied according to the invention.

A definite explanation of these results does not yet exist, but there is some support to the theory that the urethane groups are capable of reacting with hydroxy groups during the curing process wherein not only residual moisture is bound, but strong bonds between the sprayed-on metal and the polyurethane resin are also formed. It is also astonishing that particularly good results are obtained if coats are applied at just so low a thickness that the pores of the spray metal are just filled, but without a continuous film being formed. Such thin coats can be applied, for example, by brushing, rolling or spraying, but a measurable build-up of layers should not take place. Nevertheless, this thin coat already causes a great reduction of intrinsic corrosion due to humid atmospheric conditions while at the same time the adherence of the metal coat to the concrete is increased.

After this urethane paint has cured, a further improvement can be achieved, in particular, by applying a top coat of epoxy resin; excellent results have been obtained, for example, using the Amerlock 400 GFR paint from Ameron, USA. This additional epoxy resin layer is used, in particular, if the surfaces are under high mechanical stress. Layers of polyurethane or mixtures of epoxy resins and polyurethanes are also highly suitable, however.

The method according to the invention is further illustrated by the following Examples:

EXAMPLE 1

A new structure of reinforced concrete is prepared using jets of pressurized air up to a cleanliness value of Sa3 and an average roughness, $R_z$, of 45 μm. Then, the thus prepared workpiece is cleaned from adhering impurities as much as possible using pressurized air, preheated at 70 to 90° C. and provided with a zinc spray coat at a thickness of 150 to 300 μm. The adherence measurements performed by front end peeling yield values of between 1.0 and 2.0 MPa. Subsequently, the metal spray coat is coated with a commercially available low-viscosity 1 K PUR coating solution by brush application in such a way that a measurable build-up of layers does not take place. The polyurethane paint used was one from the company Steelpaint GmbH, Kitzingen.

After the coat has dried, it can be established that the adherence of the zinc coat has increased to from 2.5 to 3.0 MPa.

After the polyurethane coat had cured, part of the substrate was additionally coated with an epoxy resin coat. The material used was Amerlock 400 GFA in layer thicknesses of between 200 and 400 μm. After curing of this second coat, the adherence was from 2.5 to 3.5 MPa.

In corrosion experiments in a salt spray test according to DIN 50121-SS, virtually no measurable erosion of the zinc coat could be established.

Comparative Experiments

The same zinc spray coat as in Example 1 was immediately coated with the epoxy resin. The adherence measurement by front end peeling remains at 1.0 to 2.0 MPa. The adherence of the epoxy coat to the zinc coat was not durable.

EXAMPLE 2

Anchor arcs in need of renovation in a seaport are first externally freed from corroded concrete until the reinforcing steel parts are exposed. They are welded to one another to be all interconnected in an electrically conductive way. Further, electric lines are installed and isolated. Then, repair mortar is applied in a thickness of up to 10 cm. After curing, a zinc spray coat of 300 μm thickness is applied thereon as in Example 1 and subsequently coated with the low-viscosity PUR coating solution, but taking care that no electrically conducting contact occurs between the reinforcing steel parts and the zinc coat. The thus applied zinc coat acts as a sacrificial anode. The subsequent application of the PUR solution increases the mechanical stability of the coating. Then, the surface is coated with an epoxy resin coat as in Example 1, having an average thickness of 400 μm. Thus, a surface is formed which is highly resistant to sea water and other corrosion and ensures a long-term protection of the concrete and the incorporated reinforcing steel parts.

What is claimed is:

1. A method for improving corrosion resistance of metal-armor reinforced concrete having a pore-containing thermally sprayed metal surface coat, comprising the steps of:

providing an electrical connection between said metal surface coat and said metal armor, whereby, said surface coat acts as a sacrificial anode for said armor, without an external current connection;

applying a polyurethane resin coat, as a low-viscosity organic-solvent solution, to said surface coat at a thickness such that the polyurethane resin coat closes the pores of the surface coat, but does not form a continuous film; followed by curing the polyurethane resin.

2. The method according to claim 1, characterized in that the epoxy resin coat has a thickness, after curing, of 200–400 μm.

3. The method according to claim 2, characterized in that the metal surface coat comprises zinc or a zinc alloy.

4. The method according to claim 1, characterized in that the metal surface coat comprises zinc or a zinc alloy.

5. The method according to claim 1, further comprising the steps of:

applying an epoxy resin coat after curing the polyurethane resin; followed by curing the epoxy resin.

6. The method according to claim 5, characterized in that the epoxy resin coat has a thickness, after curing, of 200–400 μm.

7. The method according to claim 6, characterized in that the metal surface coat comprises zinc or a zinc alloy.

8. The method according to claim 5, characterized in that the metal surface coat comprises zinc or a zinc alloy.

* * * * *